US005725745A

United States Patent [19]

Ikegaya

[11] Patent Number: 5,725,745

[45] Date of Patent: Mar. 10, 1998

[54] ELECTRODE FEEDER FOR PLATING SYSTEM

[75] Inventor: Hirohiko Ikegaya, Iwata, Japan

[73] Assignee: Yamaha Hatsudoki Kabushiki Kaisha, Iwata, Japan

[21] Appl. No.: 607,579

[22] Filed: Feb. 27, 1996

[30] Foreign Application Priority Data

Feb. 27, 1995 [JP] Japan ..... 7-038540

[51] Int. Cl.[6] ..... C25B 11/00

[52] U.S. Cl. ..... 204/284; 204/285; 204/286; 204/297 R; 204/198

[58] Field of Search ..... 204/284, 285, 204/286, 297 R, 198

[56] References Cited

U.S. PATENT DOCUMENTS

| | | | |
|---|---|---|---|
| 4,569,744 | 2/1986 | Walker | 204/284 |
| 4,898,657 | 2/1990 | Hosten | 204/198 |
| 4,948,483 | 8/1990 | Hosten | 204/198 |
| 4,948,486 | 8/1990 | Hosten | 204/198 |

FOREIGN PATENT DOCUMENTS

| | | |
|---|---|---|
| 3302411 | 7/1984 | Germany . |
| 2102836 | 2/1983 | United Kingdom . |

OTHER PUBLICATIONS

European Search Report dated May 9, 1996.

*Primary Examiner*—Bruce F. Bell
*Attorney, Agent, or Firm*—Knobbe,Martens,Olson &Bear LLP

[57] ABSTRACT

A high speed electrical plating apparatus employing a moving fluid and a tubular anode. The tubular anode contains pellets of the material being plated so as to make up for those utilized during the plating process. The electrodes are configured in such a way that the electrode need not be removed for servicing and also so that the pellets need not be serviced as frequently as with prior are constructions. In addition, the electrode is configured in such a way as to permit the pellets to shift as they dissolve without jamming and also to provide more uniform plating.

49 Claims, 18 Drawing Sheets

ELECTRODE FEEDER FOR PLATING SYSTEM

BACKGROUND OF THE INVENTION

This invention relates to an improved electrode system for a plating apparatus.

In a wide variety of applications it is desirable to form a plated coating on a surface of an article. Normally, this type of plating is done with an electrolytic solution and electric power application for facilitating the deposition of the plating material on the base material. For the most part, this type of apparatus is rather slow in operation. In addition, the use of the dipping baths gives rise to certain environmental problems.

There has been proposed, therefore, a type of plating wherein, rather than immersing the body to be plated in a static solution, the solution is passed over the surface to be plated at a high flow velocity. This permits the use of large electrical current densities and accomplishes rapid plating. In addition, this type of apparatus can be more environmentally friendly.

One application for this type of plating method and apparatus is in the plating of cylinder bores for reciprocating machines. By utilizing this plating process, it is possible to make lighter weight cylinder blocks. That is, this process makes it feasible to employ light alloy castings and also to eliminate the use of thick separately inserted liners.

When plating cylindrical bores, it is the practice to employ a tubular electrode which extends into the cylinder bore and which forms a flow path that is comprised of a pair of oppositely directed axial flow path sections. One section, and that which achieves the actual plating operation, is formed between the outer periphery of the electrode and the inner periphery of the bore to be plated. The other path is provided by the hollow interior of the tubular electrode. A radially extending path interconnects these two axially extending paths at one end of the electrode. By passing the fluid through these path sections at a high velocity and applying a high electrical current density, rapid plating can be achieved.

The electrode normally forms either the anode material or a holder for pellets of the anode material which is being plated. Therefore, the anode, or at least the pellets contained with it, will diminish as the plating process continues.

With previously proposed mechanisms, it has been necessary to substantially completely disassemble the apparatus in order to remove the tubular electrode and replace the anodic material. Frequently, the tubular electrode is hollow and pellets are provided in the area between its inner and outer shells. Nevertheless, these types of apparatus require periodic replacement of the anode pellets, thus, resulting in down time. This down time is rather extensive since the apparatus must be disassembled to remove the electrode and replace the anodic pellets.

It is, therefore, a principal object of this invention to provide an improved plating apparatus of this type.

It is a further object of this invention to provide a plating apparatus of this type wherein the depleted anodic material can be replaced without significant down time.

It is a further object of this invention to provide an improved anodic electrode for electrical plating apparatus that can be easily replenished.

When utilizing an apparatus of this type and, particularly one which has a tubular electrode that forms a compartment to receive anodic pellets, as the pellets dissolve to make up the material in the fluid solution, they tend to move by gravity toward a portion of the tubular space in which they are confined. However, the pellets become irregular in shape and decrease in size. As a result their movement may not be uniform and they may jam in their compartment. This creates voids in the anode. As a result, the electrical density in certain area may be different from others and this can result in uneven plating.

It is, therefore, a still further object of this invention to provide an improved electrode structure of this type wherein the movement of the pellets as they dissolve is facilitated to avoid the likelihood of voids developing during the plating process.

In addition to the aforenoted problems, the electrical charge is normally applied to the tubular electrode at one end or the other but not normally both ends. As a result, the current density tends to be higher adjacent the end where the electricity is applied and then adjacent the remote end. This results in an uneven deposition of the plating material.

It is, therefore, a still further object of this invention to provide an improved plating apparatus of this type.

It is a still further object of this invention to provide a plating apparatus of this type wherein variation in current densities can be accommodated or compensated for so as to provide more even plating deposition.

In addition to the problem of providing a higher electric density at the end of the electrode where the electrical current is applied and, thus, a heavy plating, an inverse problem exists at the other end of the electrode. This is the end where the flow passes across the top of the electrode and at this end for a variety of reasons the plating tends to be thin.

It is a further object of this invention, therefore, to provide an improved electrical plating system of this type wherein the current density may be increased at areas where plating tends to be thin to ensure uniform plating thickness.

SUMMARY OF THE INVENTION

Various features of the invention are adapted to be embodied in an electrical anode arrangement for plating cylinder bores of work pieces. The anode is comprised of a tubular electrode consisting of an outer shell and an inner shell around which the cylinder bore to be plated is received. The electrode and the cylinder bore form a fluid path that is comprised of a first axially extending tubular section formed between the outer surface of the outer shell and inner surface of the cylinder bore. A second axially extending, tubular section is formed by the inner surface of the inner shell. Means define a generally radially extending flow path between the first and second sections at one end of the cylinder bore. At least one of the shells is perforated. The tubular space between the inner and outer shells is adapted to be filled with soluble pellets of the anodic material to be plated on the cylinder bore.

In accordance with a first feature of the invention, means are provided for supplying make-up pellets to the tubular space at a point spaced axially beyond the cylinder bore as the pellets in the space become depleted.

In accordance with another feature of the invention, one of the shells is provided with longitudinally extending slots for facilitating movement of the pellets along the axially length of the tubular area between the shells as they dissolve to avoid the formation of voids.

In accordance with a further feature of the invention, an electrical power is applied to the tubular electrode at one end thereof. Means are provided for effectively altering the electrical current density at points along the axially length of the electrode so as to promote uniform plating thickness.

DETAILED DESCRIPTION OF THE PREFERRED EMBODIMENTS OF THE INVENTION

Figure 1:
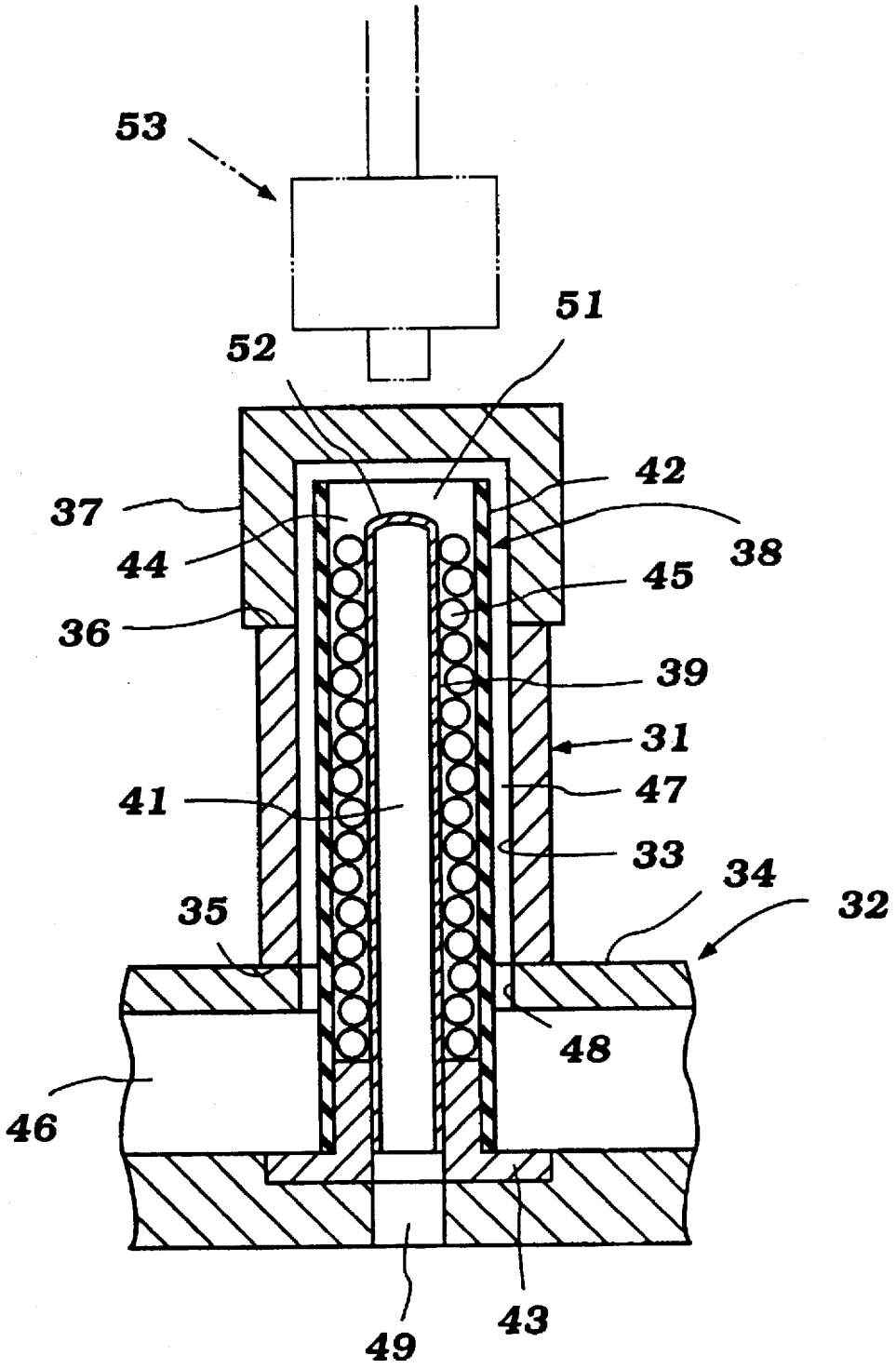
FIG. 1 is a cross-sectional view taken through a portion of a plating apparatus constructed in accordance with a first embodiment of the invention, with the pellet replacement mechanism being shown in phantom.

Referring now in detail to the drawings and initially to the embodiment of FIG. 1, an apparatus for plating work pieces such as cylinder blocks, indicated generally by the reference numeral 31 is illustrated in partial cross-sectional view and identified generally by the reference numeral 32. Certain components of the plating apparatus are not illustrated because a description and illustration of those components is not believed to be necessary to permit those skilled in the art to practice the invention.

The apparatus 32 is designed particularly for plating the cylinder bores 33 of the cylinder block 31. In the embodiment illustrated in FIG. 1, only one cylinder bore 33 is depicted, but it will be readily apparent to those skilled in the art how the invention may be practiced with multiple cylinder engines or with plural cylinder blocks and such embodiments will be described later.

The apparatus 32 includes a supporting base 34 that is brought into sealing engagement with a surface 35 formed at one end of the cylinder block 31. In most embodiments, the cylinder block surface 35 will comprise the surface of the cylinder block that is normally sealingly engaged with a detachable cylinder head (not shown). However, later embodiments will illustrate and describe other possible arrangements.

A cylinder block surface 36 is formed at the other end of the cylinder bore 33 and may comprise the surface of the cylinder block 31 which cooperates with a crankcase member to form the crankcase for the engine in which the cylinder block 31 will be used. Although the invention is described in connection with the plating of a cylinder block for an engine, it will be readily apparent to those skilled in the art how the invention may be applied with plating cylinder bores of other types of reciprocating machines, such as compressors or other cylindrical surfaces, for that matter.

A holding jig or fixture 37 is supported for movement relative to the base plate 34 and engages the cylinder block surface 36 and urges the cylinder block surface 35 into sealing engagement with the base 34. Suitable seals (not shown) may be provided for this purpose. Mechanisms for controlling the jig 37 automatically will be described later by reference to FIGS. 20 and 21.

In accordance with the plating method, a fluid containing a solution of the material to be plated is circulated through the cylinder bore 33. At the same time, an electrical charge is exerted between the plating material and specifically an anode, indicated generally by the reference numeral 38, and the cylinder block 31.

The anode 38 is the positively charged electrode of the system and is comprised of a tubular construction consisting of a generally imperforate inner tubular member 39 and which defines a central flow opening 41. An outer tubular member, indicated by the reference numeral 42 is held in spaced relationship to the inner tubular member 39 by means of a mounting base 43 on which the tubular members 39 and 42 are fitted. The outer tubular member 42 is perforated, for a reason which will be described.

The area between the inner and outer tubular members 39 and 42 defines and annular recess 44 in which pellets 45 of the material to be plated are contained and which dissolve in the circulating fluid as plated material is used up so as to replace it. In a particular type of application, the cylinder block 31 will be formed from a material, such as aluminum or aluminum alloy. The plating material may be a nickel or nickel alloy and, thus, the pellets 45 are formed from this latter material.

The base 34 is formed with a first fluid cavity 46 which is connected to a suitable circulating system for circulating the plating fluid. In this embodiment, the cavity 46 forms the inlet for the plating fluid, but it will be readily apparent that the flow can be in a reverse direction from that described.

The cavity 46 communicates with an annular chamber 47 formed between the outer periphery of the outer tubular member 42 and the cylinder bore 33 through a recessed annular opening 48 formed in the base support plate 34. This annular space forms a first flow path section that extends axially along this annular space.

At the upper end of the cylinder bore 33 and actually within the fixture 37, the fluid flows radially and then axially downwardly through the tubular interior 41 of the inner tube 39. At the lower end of the recess 43, this flow path communicates with a return conduit 49 formed in the base 34. This flow conduit communicates with a suitable conduit for the circulating system as aforedescribed.

As has been noted, the electrode 39 is positively charged and the cylinder block 31 is negatively charged so as to deposit the plating material on the cylinder bore 33. The pellets 45 will dissolve into the solution to make up the plated material and, accordingly, will deplete as the plating process continues.

In order to provide additional life before replacement pellets needs be added, the outer tube 42 extends axially well beyond the cylinder bore 33, unlike prior art type constructions. This provides a pellet reservoir 51 within the jig 37. This reservoir can be filled with additional pellets 45 and as the pellets melt or dissolve, they will move by gravity from the storage area 51 into the annular area 44 and eventually to the area facing the cylinder bore 33 for plating thereon.

In order to prevent the pellets 45 from falling into the interior 41 of the inner tube 39, a perforated screen 52 may be provided thereacross. The screen 52 has openings that are sized so as to permit the free flow of plating fluid, but small enough to preclude passage of the pellets. The pellets 45 will not tend to dissolve as much in the storage area 51, so it is unlikely that any will be small enough to pass through the screen 52 even during usage.

At certain time intervals when the pellets have been consumed, it will be necessary to refill the annular recess 44 and reservoir 51. Rather than having to remove the electrode 38, the jig 37 is only removed and a filling device 53 is brought into registry with the upper end of the pellet reservoir 51 of the electrode 38 and pellets 45 are added.

Figure 2:
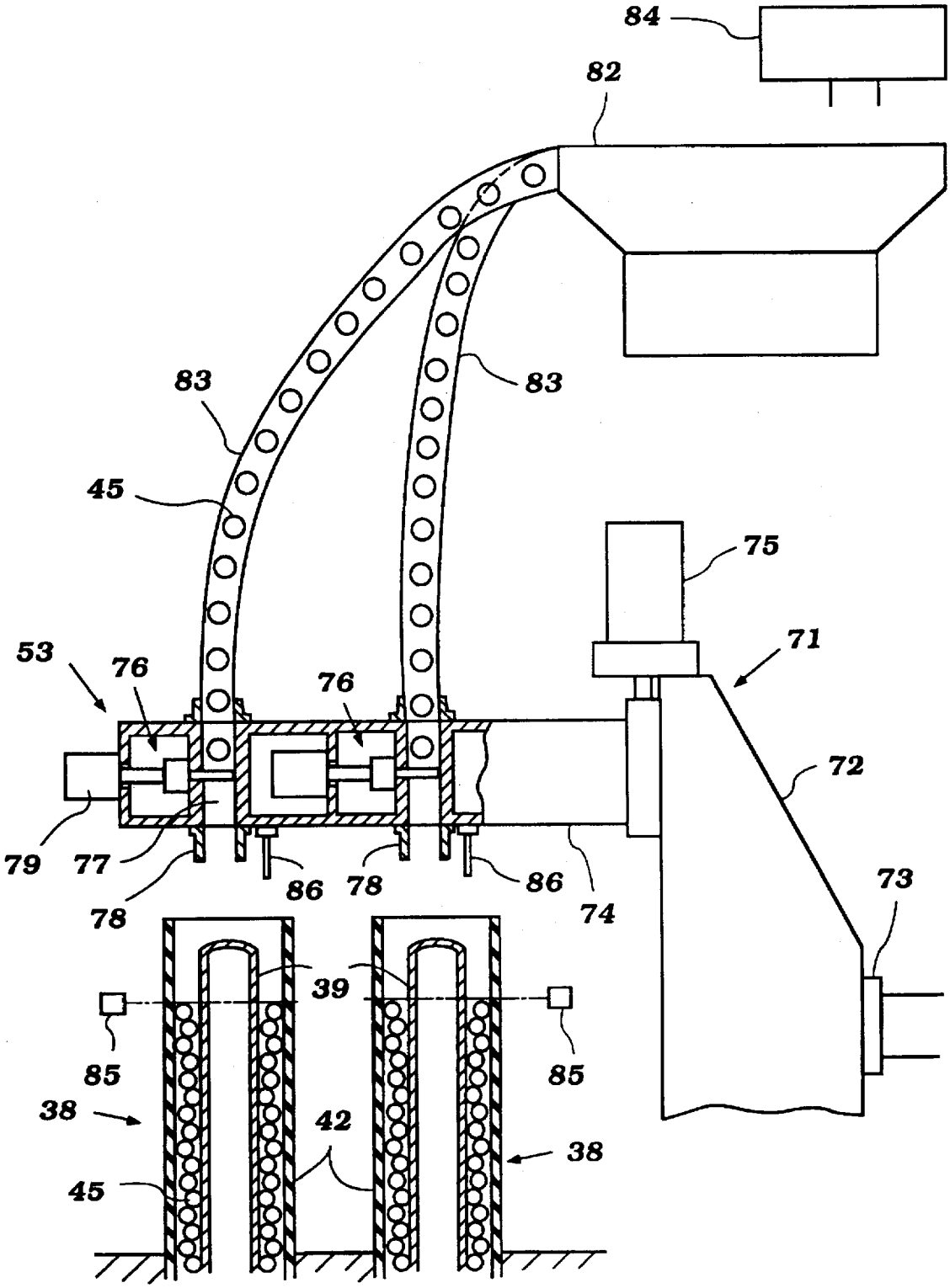
FIG. 2 is an enlarged cross-sectional view, in part similar to FIG. 1, and shows another embodiment of the invention and another way in which the depleted pellets of plating material may be replenished.
Figure 3:
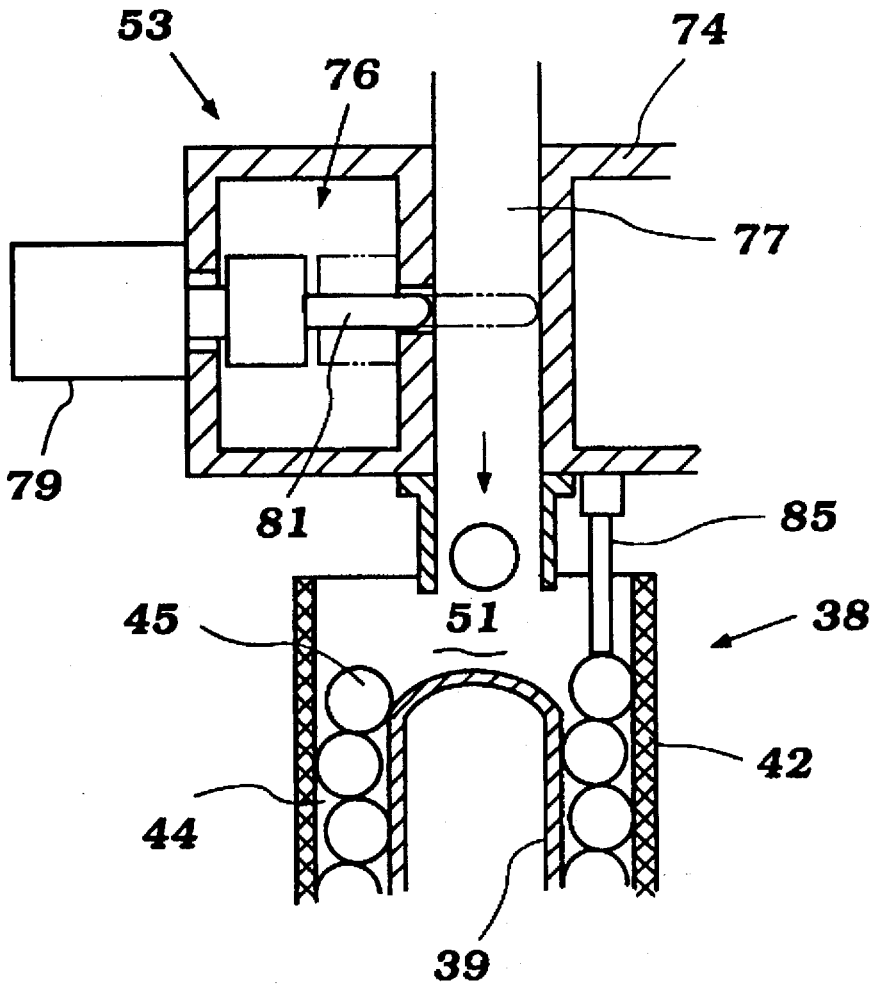
FIG. 3 is an enlarged cross-sectional view showing the pellet replacement mechanism in operation.

Referring now to FIGS. 2 and 3, this mechanism is shown in more detail and also a feeder mechanism is illustrated in some detail. The feeder mechanism is again indicated by the reference numeral 53, and functions to add pellets when required. This feeder apparatus is shown in most detail in FIG. 3.

Since the actual plating apparatus is the same as that already described, the same reference numerals have been applied to indicate like parts in this apparatus. In this embodiment, however, there are illustrated a pair of electrodes 38. By supplying a pair of electrodes 38, it is possible to plate two cylinder bores at the same time. These two cylinder bores may be the bores of an in-line two-cylinder engine or may be separate bores of separate cylinder blocks both contained within the plating apparatus and plated simultaneously. Other types of arrangements will be apparent to those skilled in the art.

The pellet feeder apparatus 53 is comprised of a main supporting base, indicated generally by the reference numeral 71 and which comprises a base fixture 72 that is adapted to be moved in a direction perpendicular to the axis of the electrodes 38 by a suitable servomotor 73. The servomotor 73 may be a hydraulic or pneumatic cylinder or other type of device.

Mounted on the base 71 is a feeder support 74 which is slidable in a direction on the base 72 in the direction of the axis of the electrodes 38. A further servomotor, such as a pneumatic servomotor 75, is mounted on the base 72 and drives the feeder base 74 from a retracted position as shown in FIG. 2 to a filling position as shown in FIG. 3.

A pair of feeder controls, indicated by the reference numeral 76 are provided, one for each electrode 38. These feeder controls control the flow of replacement pellets through a flow path 77 formed in the feeder base 74 and which have tubular extensions 78 that are adapted to enter into the outer tubes 42 in proximity to the storage compartments 51.

The control device 76 includes a servomotor 79, such as a pneumatic servomotor, that actuates a flow controlling element 81 which is either placed into the passage 77 as shown in phantom in FIG. 3 to preclude the flow pellets 45 or is withdrawn as shown in solid lines in this figure so that the pellets can pass into the storage chamber 51 of the electrodes 38.

A hopper 82 is provided at a spaced location to the plating apparatus and supplies pellets to the feeder 74 through flexible conduits 83 so as to accommodate the movement of the feeder 74 relative to the plating section. Pellets of the appropriate size are delivered to the feeder 82 through a sorter or shifter 84 that will exclude particles over a certain size.

In order to determine when it is necessary to add to the anode pellets 45, there is provided a sensing mechanism, such as sensors, indicated schematically at 85, which are juxtaposed. to the electrode 38 and which sense when the level of the pellets 45 falls below a predetermined amount. At that time, the feeder head 53 is moved by the servomotor 73 and 75 into the position shown in FIG. 3 and the control element 81 is moved to a position wherein pellets can fill the storage chamber 51.

Touch type sensors 86 are carried by the feeder head 74 and will determine when the pellets 45 reach the appropriate height at which time the flow controller 81 is moved to the phantom line position in FIG. 3 to cut off the flow. The feeder head 74 is then retracted and the plating process can be completed.

Figure 4:
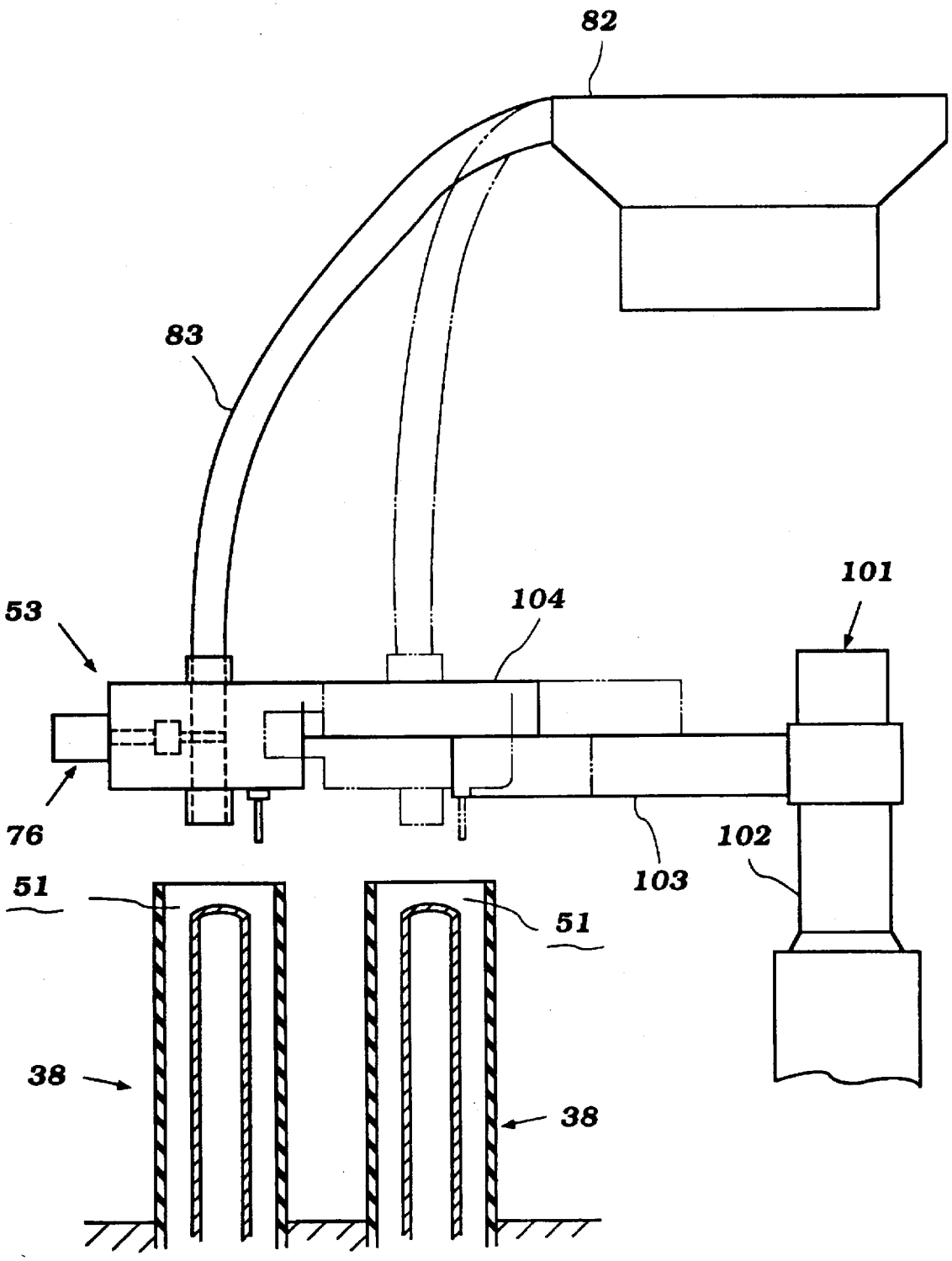
FIG. 4 is a cross-sectional view, in part similar to FIG. 2, and shows another embodiment of the invention.

FIG. 4 shows another embodiment of the invention which is generally the same as the embodiment of FIGS. 2 and 3, but wherein a different type of device is employed for bringing the feeder head 33 into position for supplying replacement pellets to the electrode storage area 51.

This mechanism includes a robot, indicated generally by the reference numeral 101 which has a base section 102 that operates a pair of articulated arms 103 and 104 which, in turn, carry the feeder head 73. Hence, by operating the arms 103 and 104, the feeder head 53 may be either retracted so that cylinder blocks may be plated or extended so as to place the feeder head 53 over the electrodes 38. The base section 102 is telescopic so as to raise and lower the feeder head 53 to a feeding position similar to that shown in FIG. 3.

Figure 5:
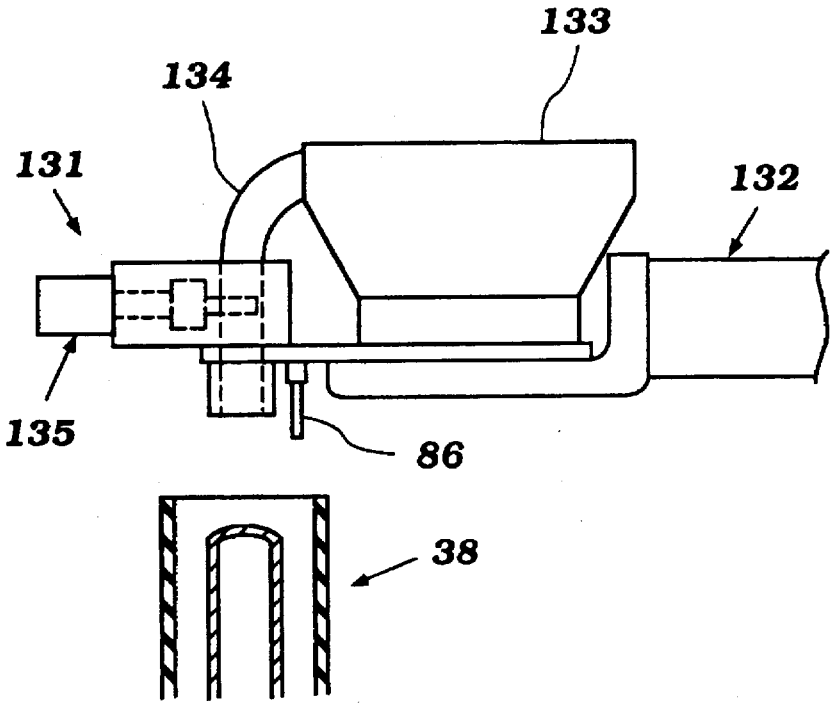
FIG. 5 is a partial cross-sectional view, in part similar to FIGS. 2 and 4, and shows a further embodiment of the invention.
Figure 6:
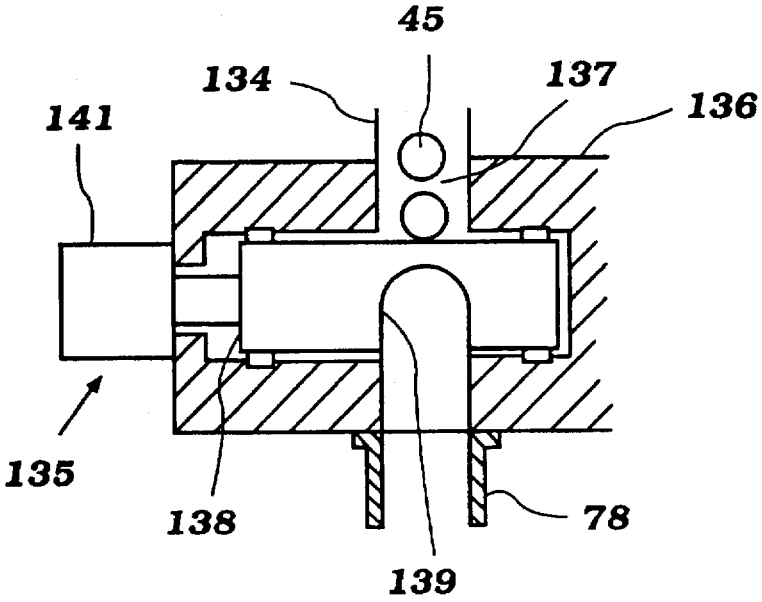
FIG. 6 is an enlarged cross-sectional view showing the pellet controlling mechanism of the embodiment of FIG. 5.

FIGS. 5 and 6 shown another embodiment wherein the pellets 45 that have been depleted may be replaced. This embodiment includes a different type of flow control, indicated generally by the reference numeral 131 which is carried on an appropriate robot 132 for bringing the feeder 131 into position over the electrodes 38 for refilling them.

In this embodiment, there actual hopper 133 for the replacement pellets is carried by the robot arm 132 and, hence, a rigid tube 134 may be employed for delivering the pellets to a flow controller 135 which has a construction best shown in FIG. 6. In this embodiment, a base portion 136 is provided with a flow passage 137 that receives the pellets 45 from the tube 134.

A rotary plug type valve having a valve element 138 is supported in the base portion 136 and has a notch or cutout 139 that may be rotated into registry with the flow path 137 by a servomotor 141. When so rotated, the pellets 45 may pass through the flow path 137 into the storage area 51 of the electrodes 38 in a manner which is believed to be apparent.

Figure 7:
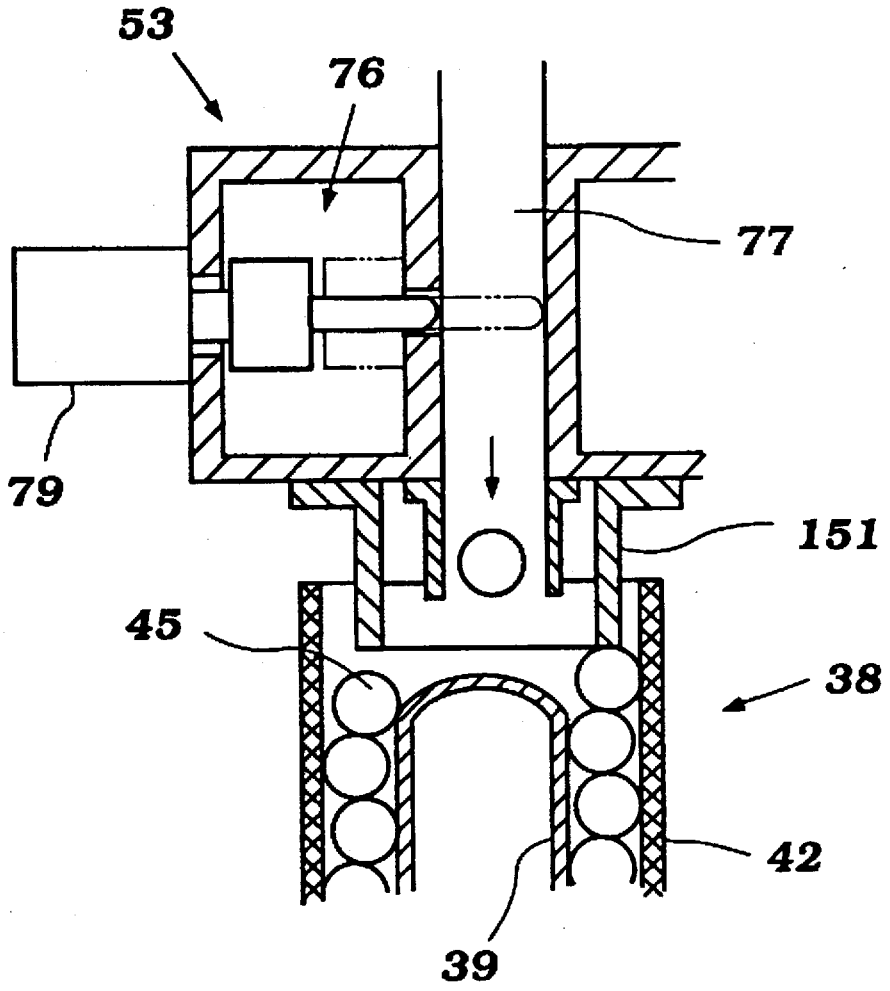
FIG. 7 is a partial cross-sectional view, in part similar to FIGS. 1, 2, 4 and 5, and shows a still further embodiment of the invention.

FIG. 7 is a partial cross-sectional view that shows another embodiment of the invention and which is similar to the construction shown in FIG. 3. Where components of this embodiment are the same as those of that embodiment, they are identified by the same reference numerals and will not be described again.

The difference between this embodiment and the previous embodiment is in the construction of the touch type sensor, indicated by the reference numeral 151. Unlike the previous sensor using a probe 86, the sensor 151 is totally annular and, thus, is able to more accurately reflect the filled capacity of the storage area 51 and the point when feeding of pellets 45 should be cut off.

Figure 8:
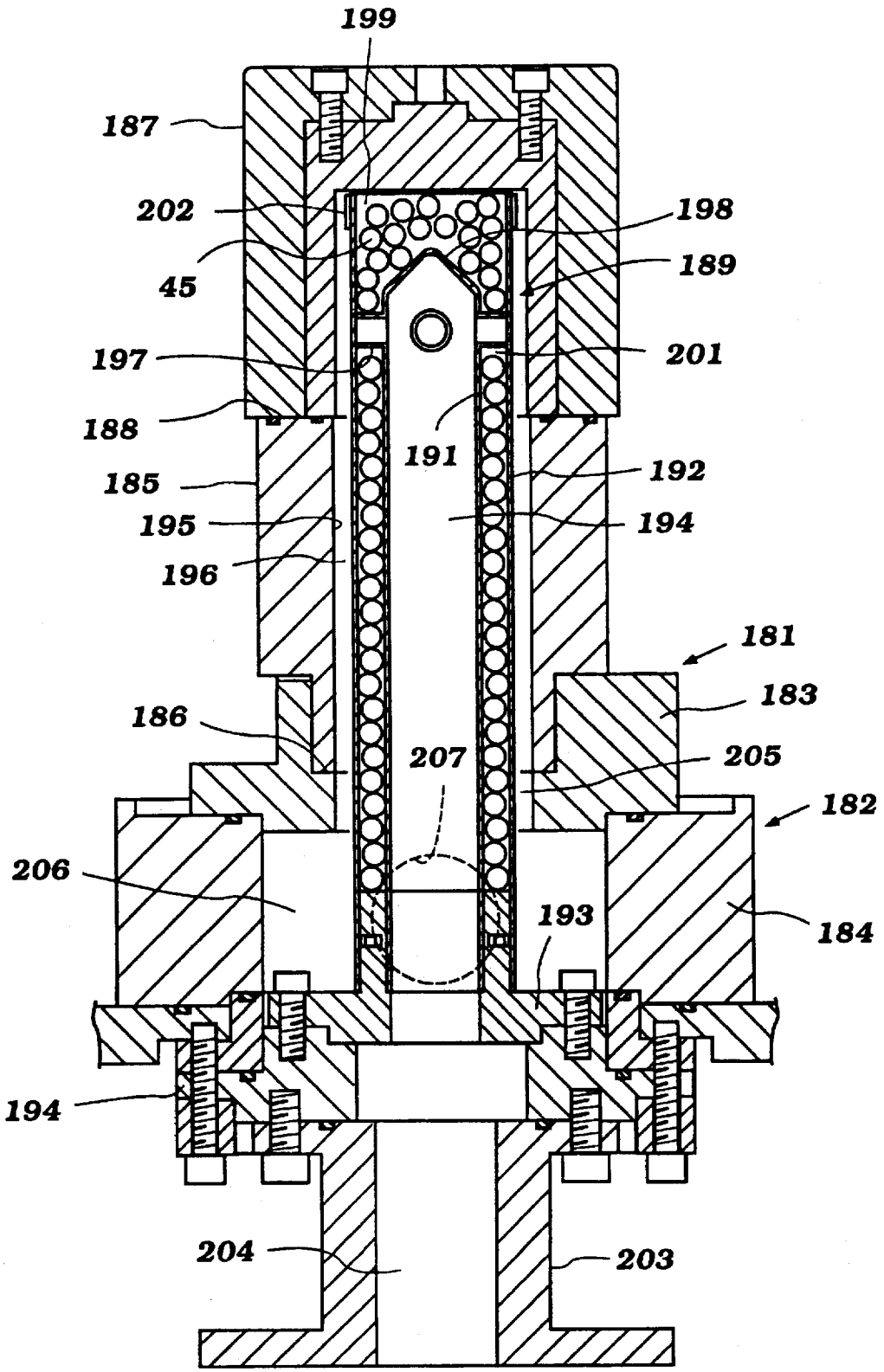
FIG. 8 is an enlarged cross-sectional view, in part similar to FIGS. 1, 2 and 4, and shows another embodiment of the invention.

Another embodiment of plating apparatus is shown in detail in FIG. 8 and is identified generally by the reference numeral 181. This feeding apparatus includes a base assembly, indicated generally by the reference numeral 182 which includes a mounting fixture 183 mounted on a base plate 184. The mounting fixture 182 mounts a cylinder block 185. In this embodiment, the lower portion of a cylinder block sleeve part 186, which is the crankcase end of the cylinder block 185, is received in the mounting fixture 183.

A holding jig 187 engages the cylinder head engaging surface 188 of the cylinder block 185 and holds it in position in the fixture 181 and also provides a seal with this portion of the cylinder block.

In this embodiment, an electrode, indicated generally by the reference numeral 189 is formed, again, as a tubular construction consisting of an inner tube 191 and an outer tube 192. These inner and outer tubes are mounted on a base fixture 193 which is affixed to the base plate assembly and particularly a base fitting 194 thereof by threaded fastener 194. This forms a first flow passage section 204 which, like the previously described embodiments, extends coaxially with the cylinder bore 195 of the cylinder block 185. An annular second flow path section 196 is formed between the outer surface of the outer shell 192 and the cylinder bore 195 and forms the continuing flow path.

In this embodiment, a plurality of tubular members 197 provide the radial flow path between the axial flow paths 194 and 196. This flow path is also formed at the upper end of the assembly and axially beyond the cylinder bore 195.

The inner tuber 191 is provided with a perforated closure member 198 that prevents the pellets 45 from falling into the inner tube 191.. A storage area 199 is formed in the upper portion of the tubes 191 and 192, and communicates with the annular space 201 formed therebetween so that pellets can pass into the inner structure.

In this embodiment, the jig 187 actually contacts the upper end of the inner tube 191 and forms a closure to retain the pellets in the storage area 199 when in the position shown in FIG. 8. A reinforcing ring 202 may be provided around the outer tube 192 so as to add rigidity.

A base plate fitting 203 supplies a first flow path 204 which is axially aligned with the inner flow path section 194 of the electrode 189. The mounting fixture 183 has a lower diameter opening 205 that forms a flow communication with a fluid area 206 formed in the base assembly 182. A suitable fitting 207 communicates with this fluid chamber 206.

Again, the flow may be either direction. As with the previous described embodiments, the fluid flow may flow axially up the flow path section 196, radially through the tubes 197 and axially downwardly through the inner tube passage 194 for discharge through the fitting passage 207.

As with the previously described embodiments, the electrode or anode 189 is positively charged and the cylinder block 185 is negatively charged by a suitable electrical power source so as to cause the electric deposition of the plating material on the cylinder bore 195.

Figure 9:
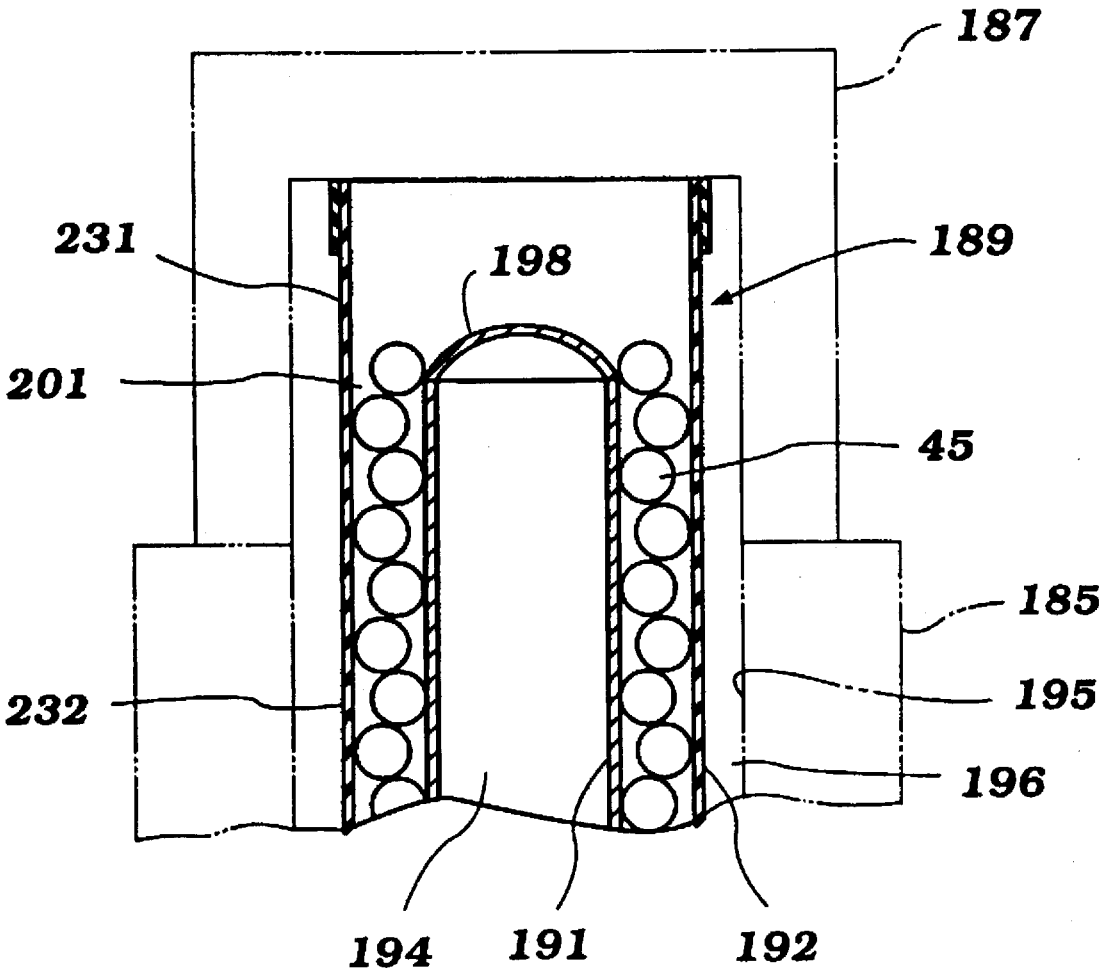
FIG. 9 is an enlarged partial cross-sectional view showing the upper end of the tubular anode structure constructed in accordance with still another embodiment of the invention.

FIG. 9 shows another embodiment which is basically the same as the embodiment of FIG. 8. For that reason, components of this embodiment which are the same as that earlier embodiment have been identified by the same reference numerals. The basic difference in this embodiment from the previous ones is the way in which the radial flow path between the annular flow path 196 and the inner tube flow path section 194 is accomplished. Also, the shape of the end closure 198 is slightly different.

The outer shell 192 in this embodiment is provided at its upper end With a perforated area that is comprised of larger diameter openings 231 than those of previously described embodiments. These openings 231 are large enough to permit free flow, but small enough to prevent the pellets 45 from finding their way outside of the outer tube 192. The openings 231 are large in diameter than the openings, indicated by the reference numeral 232 formed in the perforated portion of the outer tube 192 that faces the cylinder bore 195.

Figure 12:
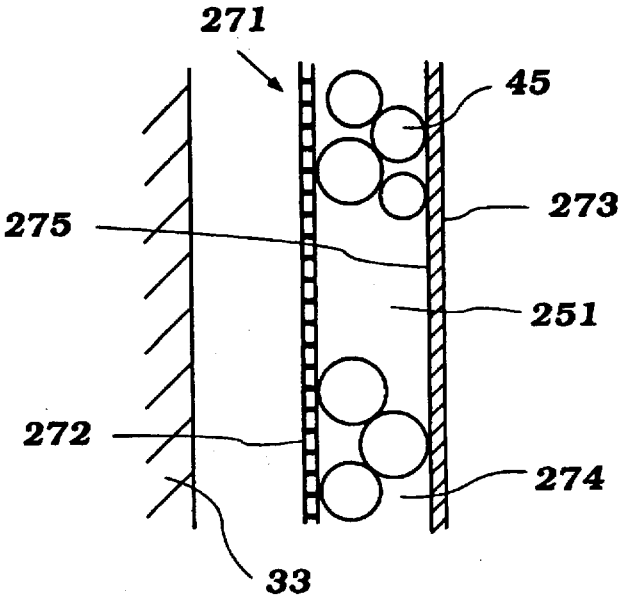
FIG. 12 is an enlarged partial cross-sectional view, in part similar to FIG. 11, and shows another embodiment wherein an arrangement is provided for ensuring uniform deposition of the plating even if voids do occur in the pellets.

In all of the embodiments thus far described, the outer tubular member of the electrode has been provided with perforated openings so as to permit the free passage of the dissolved plating material from the pellets 45 to pass through and replenish the deposited material. Obviously, the size of the pellets 45 will decrease as they dissolve. Eventually, the pellets may reach a condition where they are small enough to partially enter into the openings in the outer tube and, thus, can preclude their free movement. This can result in the pellets becoming clogged or logged as shown in FIG. 12 wherein voids 251 will form between the pellets 45 of different sizes.

Figure 10:
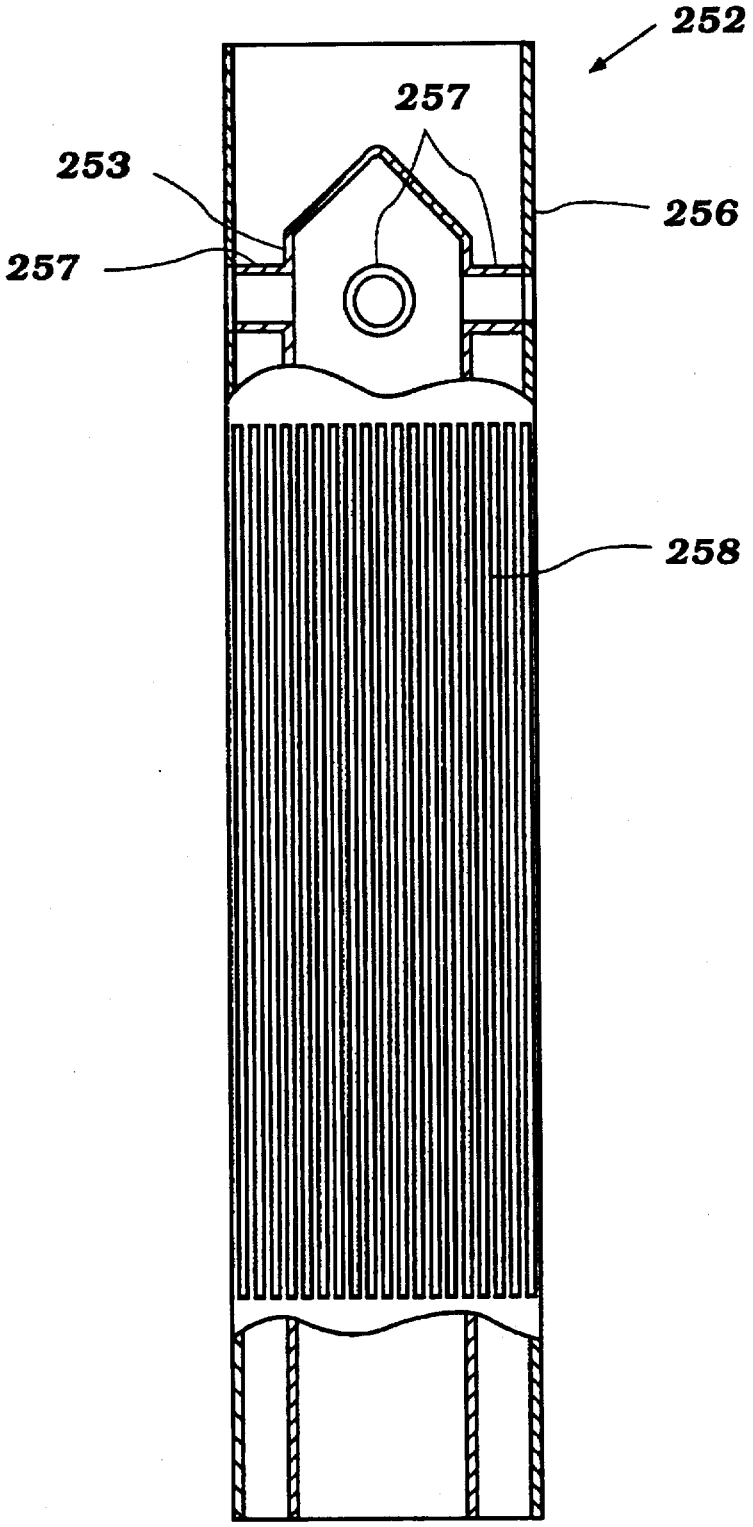
FIG. 10 is a partial side elevational view, with portions broken away, of an electrode constructed in accordance with yet another embodiment of the invention.
Figure 11:
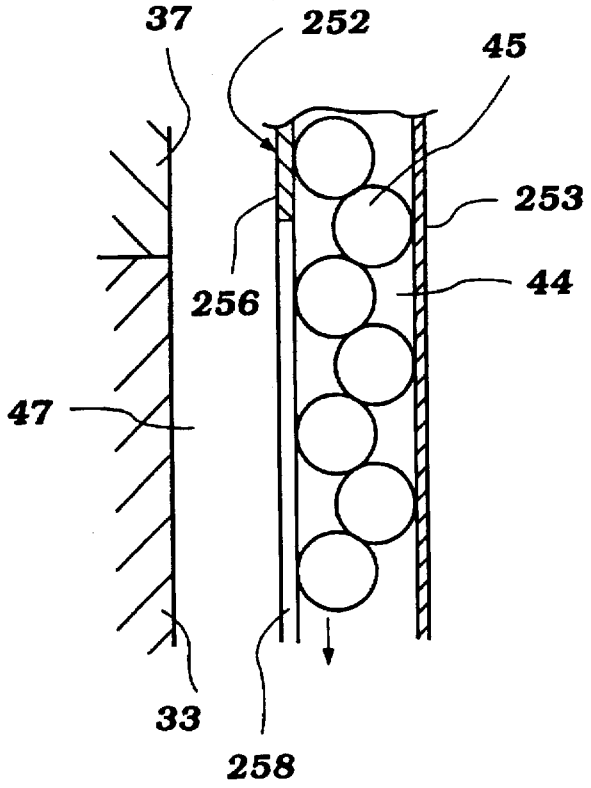
FIG. 11 is an enlarged cross-sectional view taken through a portion of the electrode as shown in FIG. 10 and illustrating how the structure avoids the formation of voids in the pellets contained within the interior of the electrode structure.

FIGS. 10 and 11 show an embodiment and construction that is design so as to reduce the likelihood of this occurring. The electrode or anode constructed in accordance with this embodiment is identified generally by the reference numeral 252 and like the previous embodiments includes an inner tube 253 and an outer 256. In this embodiment, the outer tube and inner tube 253 and 254 are provided at their upper ends with cross-tubes 257 that provide radial flow path whereby the fluid may interchange between two aforedescribed axial flow paths, one defined by the inner diameter of the inner tube 253 and the other defined between the outer diameter of the outer tube 256 and the cylinder bore which is not shown in these figures.

In this embodiment, the outer tube 256 is provided with a plurality of longitudinally extending slots 258. Hence, because of these slots 258, the effective diameter or width of the gap 44 is increased and jamming of the pellets 45 is precluded or substantially restricted.

One problem existent with the formation of voids in the pellets in the surface spacing the cylinder bore 33 is that the actual platting layer may be diminished where the voids exist. Another way of avoiding this effect is illustrated in the embodiment of FIG. 12.

In this embodiment, the electrode or anode is indicated generally by the reference numeral 271 and includes a perforated outer shell 272 and a generally solid inner shell 273 which define a gap 274 between them in which the pellets 45 are contained. As may be seen, if a void 251 develops, there may be a reduction in the thickness of the plating on the facing side of the cylinder bore 33.

This is avoided by providing a plating of a non-soluble anode material, indicated by the reference numeral 275 on the entire outer surface of the inner shell 273. This anode layer provides a more conductive area between the charged electrode and the cylinder wall surface 33 so as to provide a greater current density. Therefore, the amount of plating in this area will be increased and this increase is sufficient to make up for the lack of plating that would occur did the void 251 not exist. Said another way, the absence of anode pellets in this area is compensated for by the higher current density which results in an increase in the amount of deposition of plating materials.

From the aforenoted description, it will be apparent that the current density also determines the amount of plating buildup in a given area. As has been noted, the electrodes of the various described embodiments are connected to the base only at their lower portion and are spaced at their upper end from any other component, except in some instances the jig which holds the cylinder block in position.

This means that the electrical power source is connected to the electrode at only one end. Hence, there will be a higher current density existent at this end than the remote end. As a result, the adjacent end of the cylinder bore will receive a thicker plating layer than the remote end. This is also undesirable in many instances.

Figure 13:
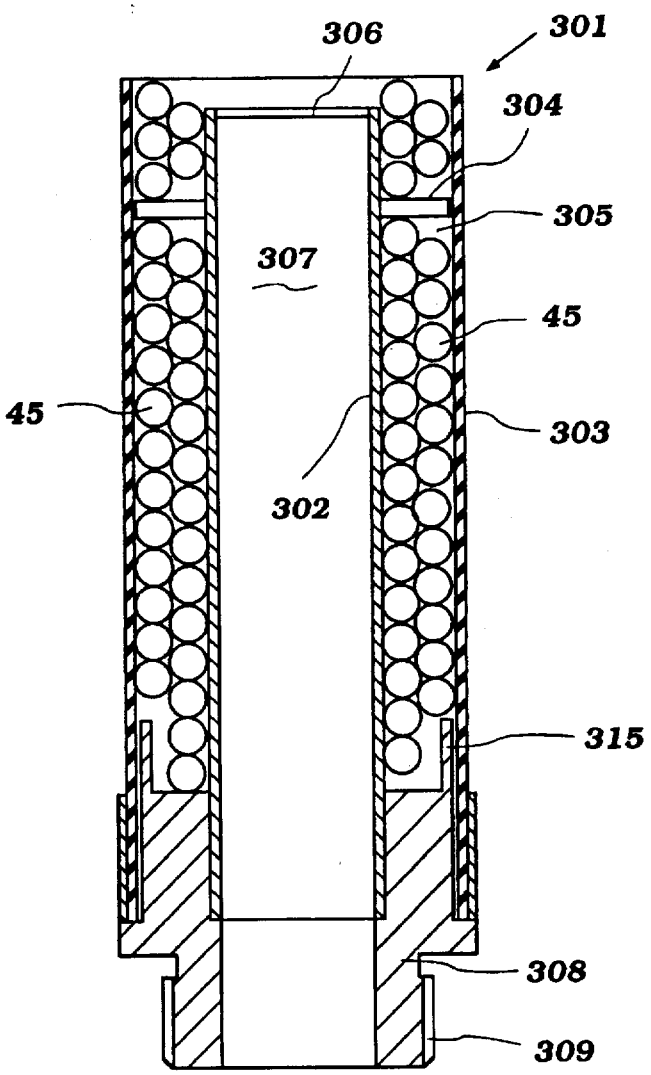
FIG. 13 is a cross-sectional view taken through an electrode construction in accordance with another embodiment of the invention.
Figure 14:
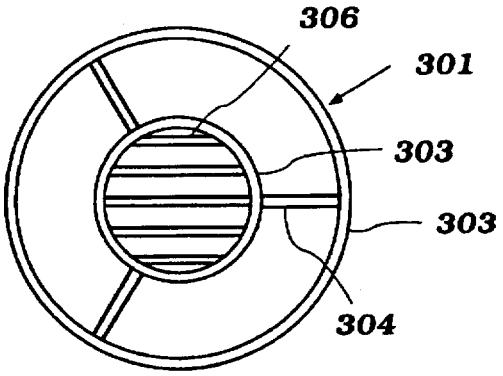
FIG. 14 is a top plan view of the electrode construction shown in FIG. 13.
Figure 15:
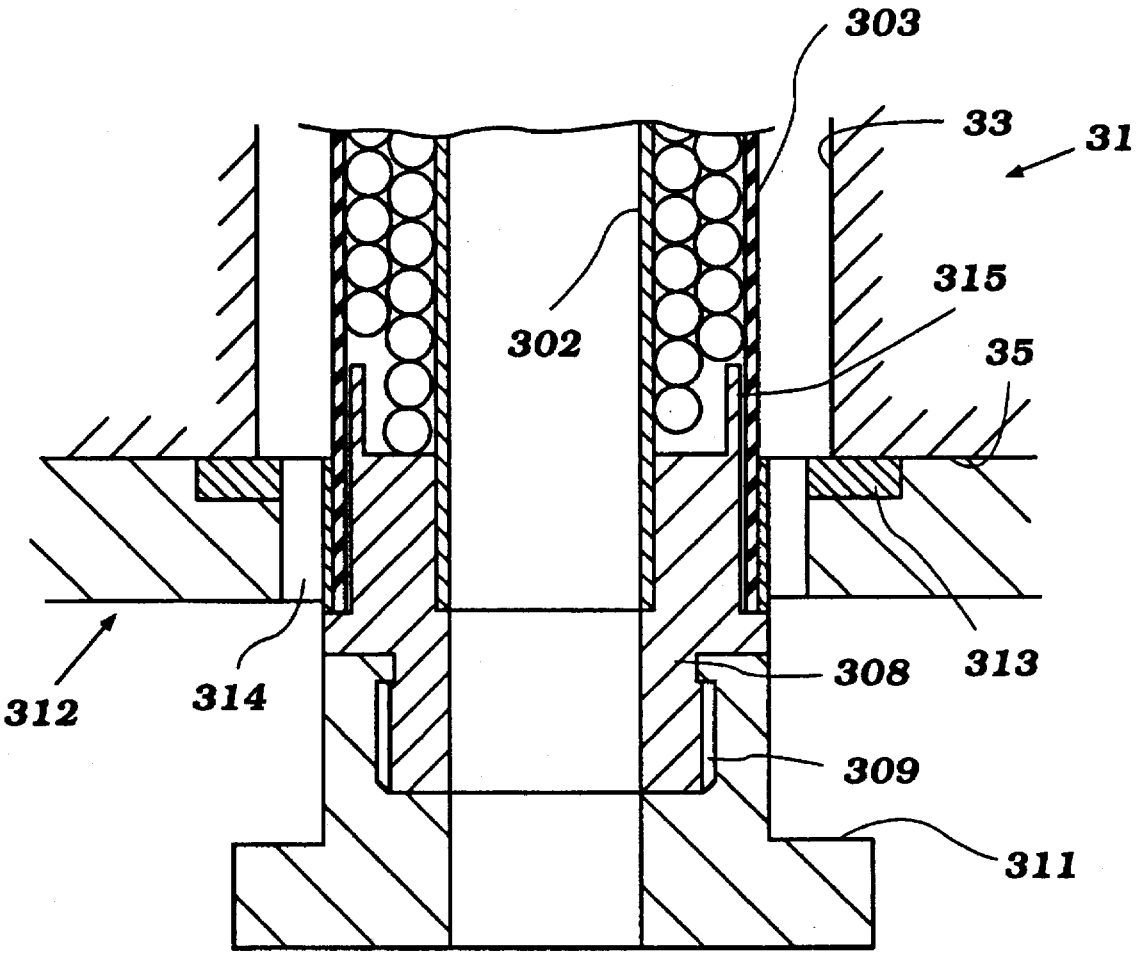
FIG. 15 is a partial cross-sectional view showing how the electrode of the embodiment of FIGS. 13 and 14 is mounted in the plating apparatus.

An electrode or anode, indicated generally by the reference numeral 301 is illustrated in the embodiment of FIGS. 13–15 and avoids this problem. The electrode includes an inner shell 302 and an outer shell 303 which is perforated as aforedescribed. A plurality of supporting rods 304 extend between the inner shell 302 and the outer shell 303 so as to maintain the spacing therebetween. These rods 304 are positioned at the upper end of the gap 305 that exists between the inner and outer shells and in which the anode material pellets 45 are contained.

A plurality of finely spaced bars 306 extend across the upper end of the inner tube. 302 so as to prevent the pellets from falling into the hollow interior 307 of the inner tube 302.

The lower ends of the inner and outer tubes 302 and 303, respectively, are held in spaced relationship by a mounting base fitting 308 having a threaded lower end 309. As seen in FIG. 15, this threaded fitting 309 is received in a female threaded opening of a support base 311.

The support base 311 is, in turn, affixed in a suitable manner to a base plate 312 which carries a seal 313 for sealing engagement around a flow gap 314 with the corresponding surface 35 of the cylinder block 31. It will be seen that the base 308 is further provided with an upstanding cylindrical shield 315 adjacent the cylinder head surface 35. This shield 315 offers electrical resistance and, thus, reduces the current density in this otherwise high area. As a result, the structure will provide more uniform plating, since the high current area is shielded from the adjacent portion of the cylinder bore 33.

In all of the embodiments as thus far described, a storage area for additional anode pellets 45 has been formed at what amounts to the upper end of the cylinder bore 33 relative to the mounting base. In some instances, it may not be possible to provide this storage area. Next will be described a number of embodiments wherein the storage area is provides in the area below the mounting plate 32 and cylinder block 31.

Figure 16:
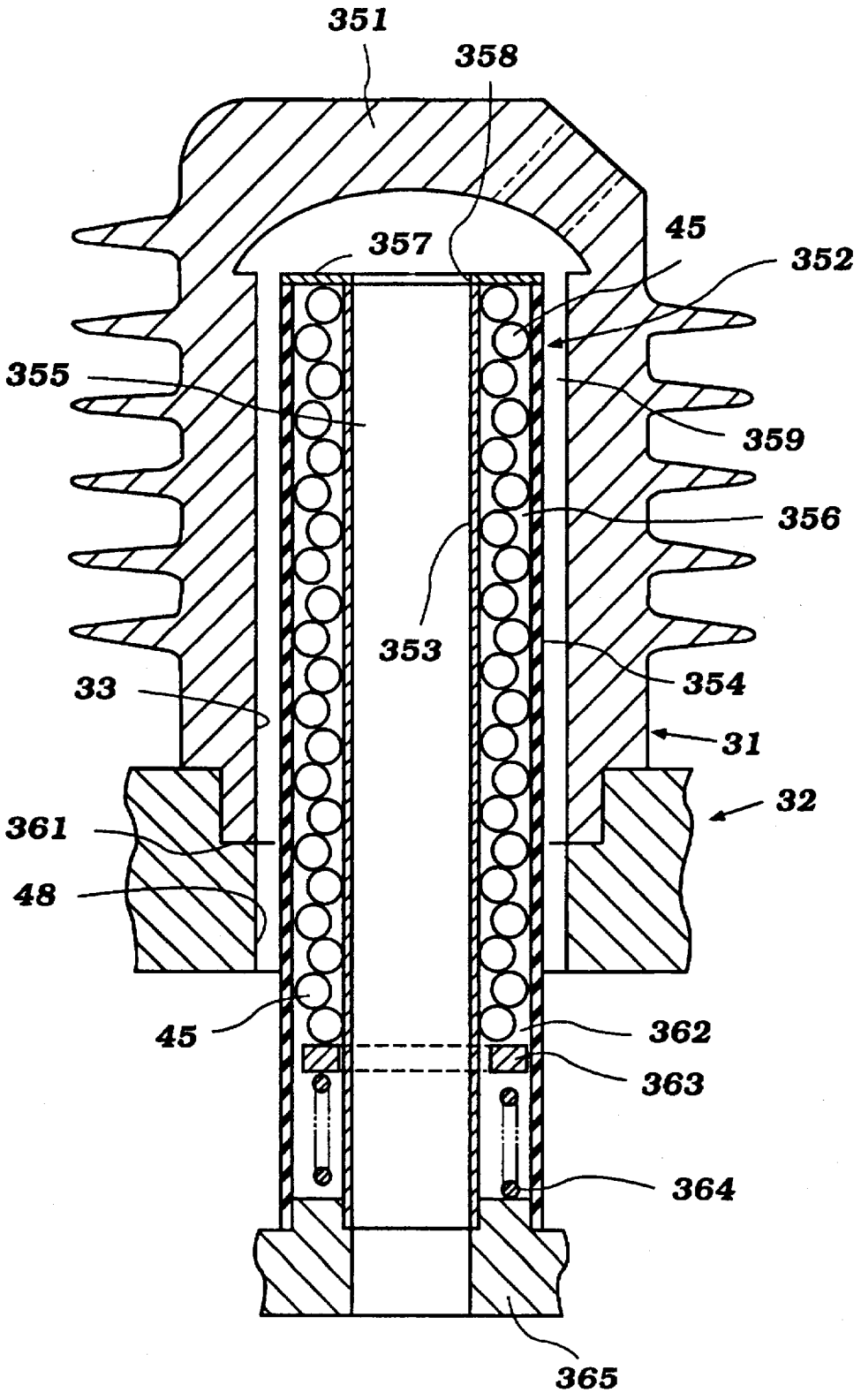
FIG. 16 is a cross-sectional view taken through a plating apparatus constructed in accordance with yet another embodiment of the invention.

Turning first to the embodiment of FIG. 16, it will be seen that the cylinder block 31 is in this embodiment formed with an integral cylinder head 351. Because of this, the electrode, indicated generally by the reference numeral 352, cannot extend beyond the cylinder bore 33 to any great extent. Thus, a storage area is provided at the opposite end of the electrode 352 from the cylinder head 351 and, specifically, in the area below the supporting base 32.

As with the previously described embodiments, the electrode 352 is comprised of an inner shell 353 and an outer shell 354 which is perforated. The inner shell 353 forms a inner flow path section 355 which communicates at its lower end with the fluid source. The mounting base 32 has, like the previously described embodiments, an enlarged opening 48 that defines the axial other end of this flow path. In this embodiment, the upper end of the space 356 in which the pellets 45 are received is closed by an annular closure ring 357. This ring 357 leaves an opening 358 to accommodate the radial flow between the flow path 355 and the annular flow path 359 formed between the outer shell 354 and the cylinder bore 33.

It will be seen that the inner and outer shells 353 and 354 extend a substantial distance below the lower cylinder head surface, indicated by the reference numeral 361 and below the mounting base 32. Hence, a storage volume 362 is formed in this lower area in which storage pellets 45 may be contained. As the pellets above them dissolve, the lower pellets are forced upwardly by a pressure ring 363 that is mounted in the volume 362 and urged by a coil compression spring 364 upwardly. The other end of the coil compression spring 364 is engaged with an end plate 365 which also functions to space the lower ends of the inner and outer tubes 353 and 354 from each other.

Hence, as the pellets 45 dissolve, the spring biased ring 363 will continue to urge the pellets upwardly until they are exhausted or reach such a number that the electrode 352 should be removed and refilled.

With the embodiment of FIG. 16, since the lower end of the electrode 352 is positioned well below the lower end of the cylinder bore 33, the mounting base 32 acts as a shield member to prevent the high current density areas as may exist in the other embodiments from causing an undue or thickened plating at this end of the cylinder bore.

Figure 17:
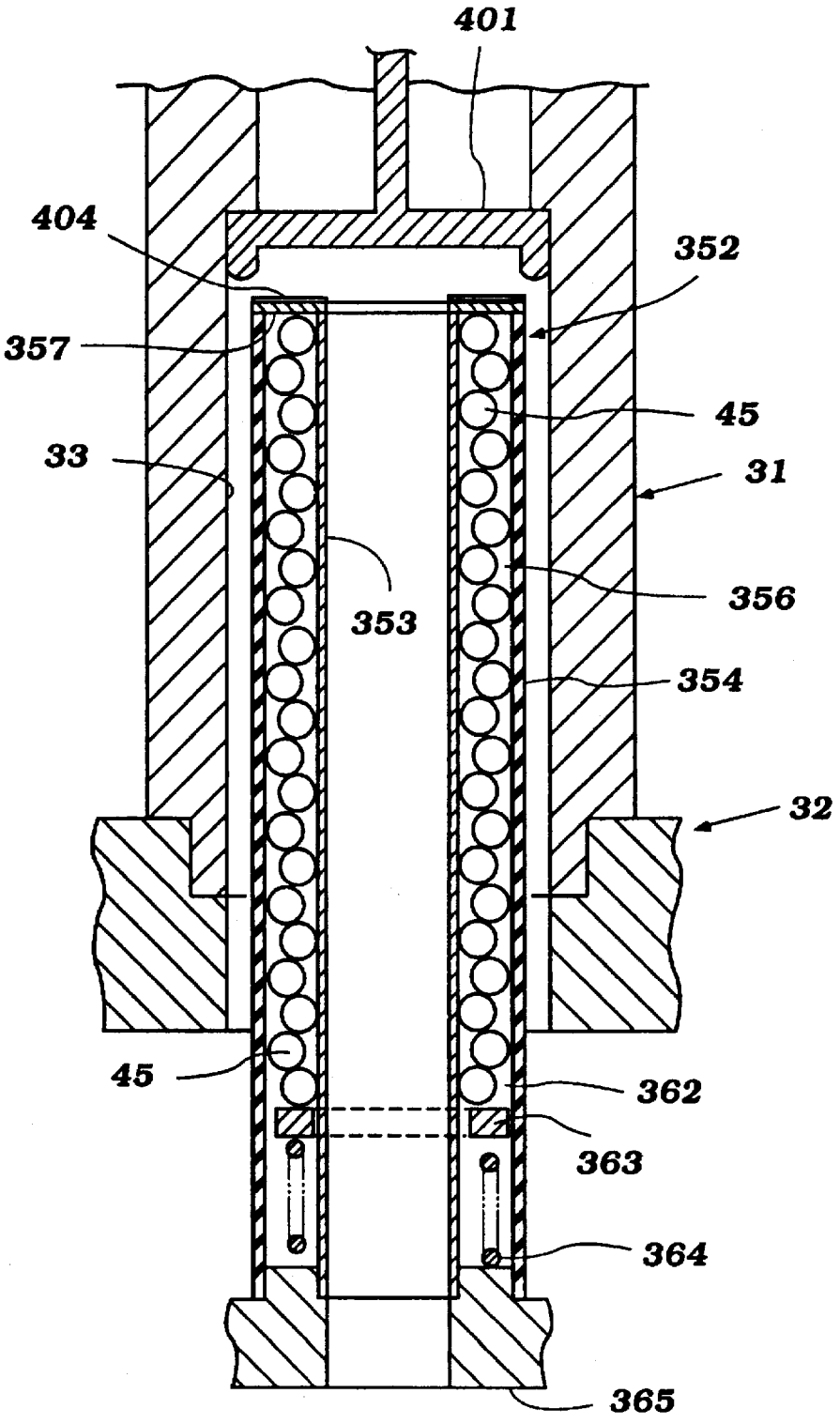
FIG. 17 is a cross-section view, in part similar to FIG. 16, and shows another embodiment of the invention.
Figure 18:
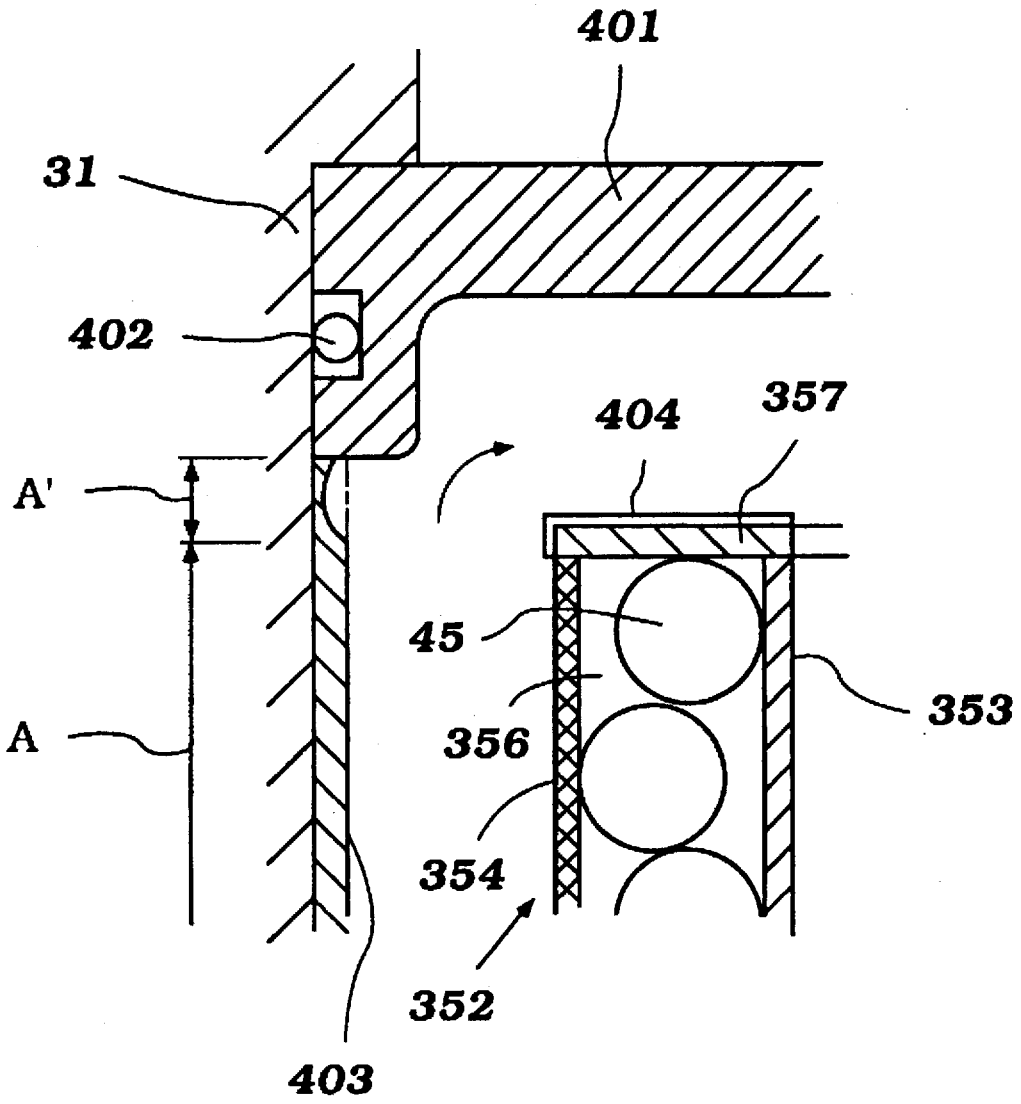
FIG. 18 is an enlarged cross-sectional view taken through an upper corner of the electrode of the embodiment of FIG. 17 and shows how this embodiment of the invention acts to promote uniform plating at the end of the cylinder bore.

FIGS. 17 and 18 show another embodiment similar to the embodiment of FIG. 16, but which also presents another type of solution to the uneven plating problem. It should be noted that in these embodiments, the electrode 352 does not extend totally to the upper end of the cylinder bore surface 33 to be plated. As a result, at the upper end there may be a low enough current density to cause a thinning in the plating as seen in FIG. 18. In the area about the anode pellets 45, and indicated by the area A' above the remaining cylinder bore A there may be a thin plating area due to the reduced current density. This embodiment provides a solution to this problem.

In this embodiment, the cylinder block 31 is of a different type and one in which the upper end of the cylinder bore 33 is sealed by a sealing plug 401 which carries an O-ring seal 402 that engages the cylinder block so as to provide a seal therewith.

This end closure 401 does not permit the electrode or anode 352 to extend upwardly beyond the end of the cylinder bore and, hence, the area A' may result in a thinning of the plating layer, indicated by the reference numeral 403 in this figure. Therefore, an insoluble anode plating such as platinum 404 is formed on the ring 357. This plating material offers a high current density in this area and, accordingly, the thinning will not be present and the plating layer will be uniform.

Figure 19:
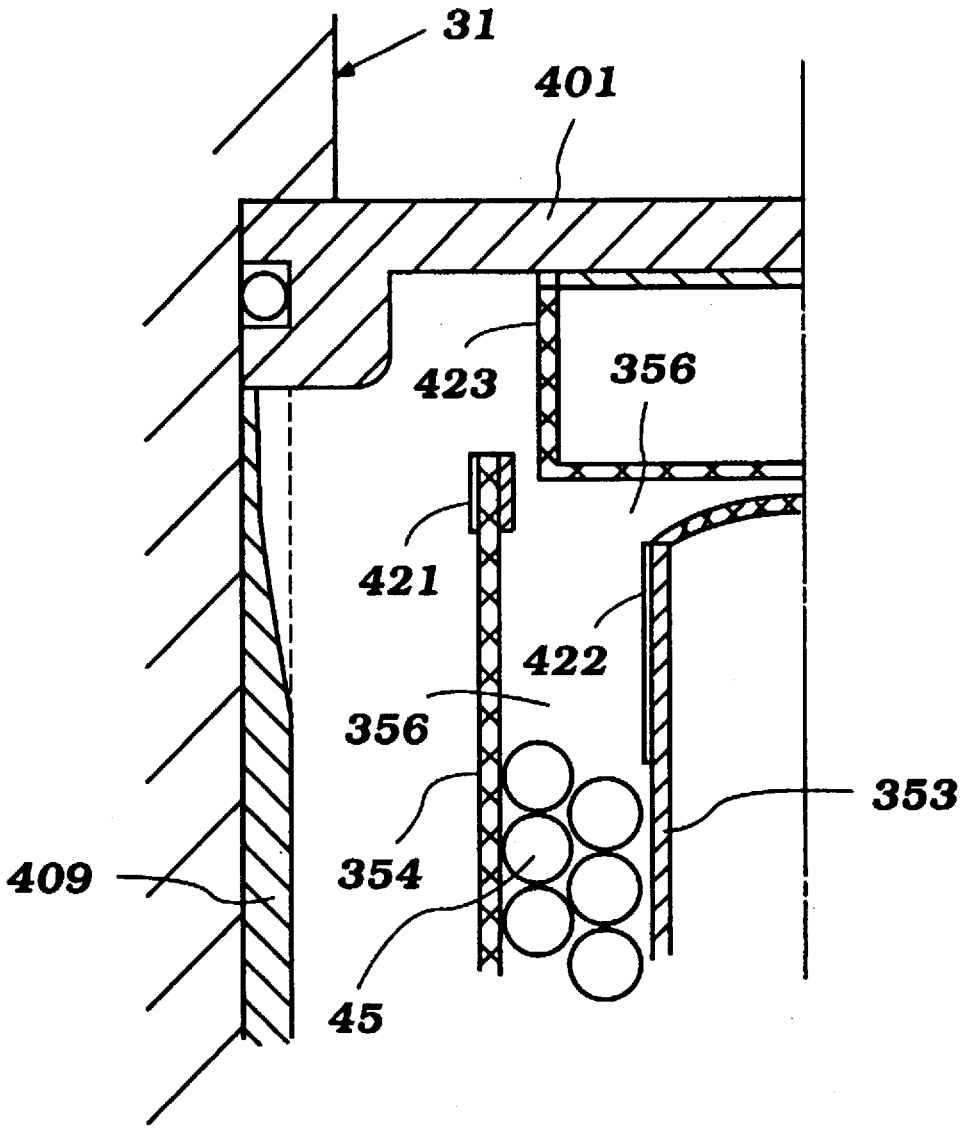
FIG. 19 is a partial cross-sectional view, in part similar to FIG. 18, and shows another embodiment utilized to avoid unequal plating thickness.

FIG. 19 shows another embodiment which achieves this same result in a slightly different manner. In this embodiment, an end plate is not employed on the electrode 352 which otherwise has a construction as in the embodiment of FIGS. 16, 17 and 18 and, therefore, its components have been identified by the same reference numerals. In this embodiment, the upper portion of the outer shell 354 is provided with an insoluble anode material 421 which again may constitute a platinum plating layer. In addition, the area of the gap 356 at the upper end of the inner shell 353 is also provided with an insoluble anode plating layer 422 also of platinum.

The upper end of the gap 356 is closed by an end cap 423 of the end cap 401 so as to ensure that the pellets 45 cannot become displaced. Therefore, this construction also ensures against the thinning of the plating layer as would otherwise occur as shown by the solid and phantom lines of this figure.

Figure 20:
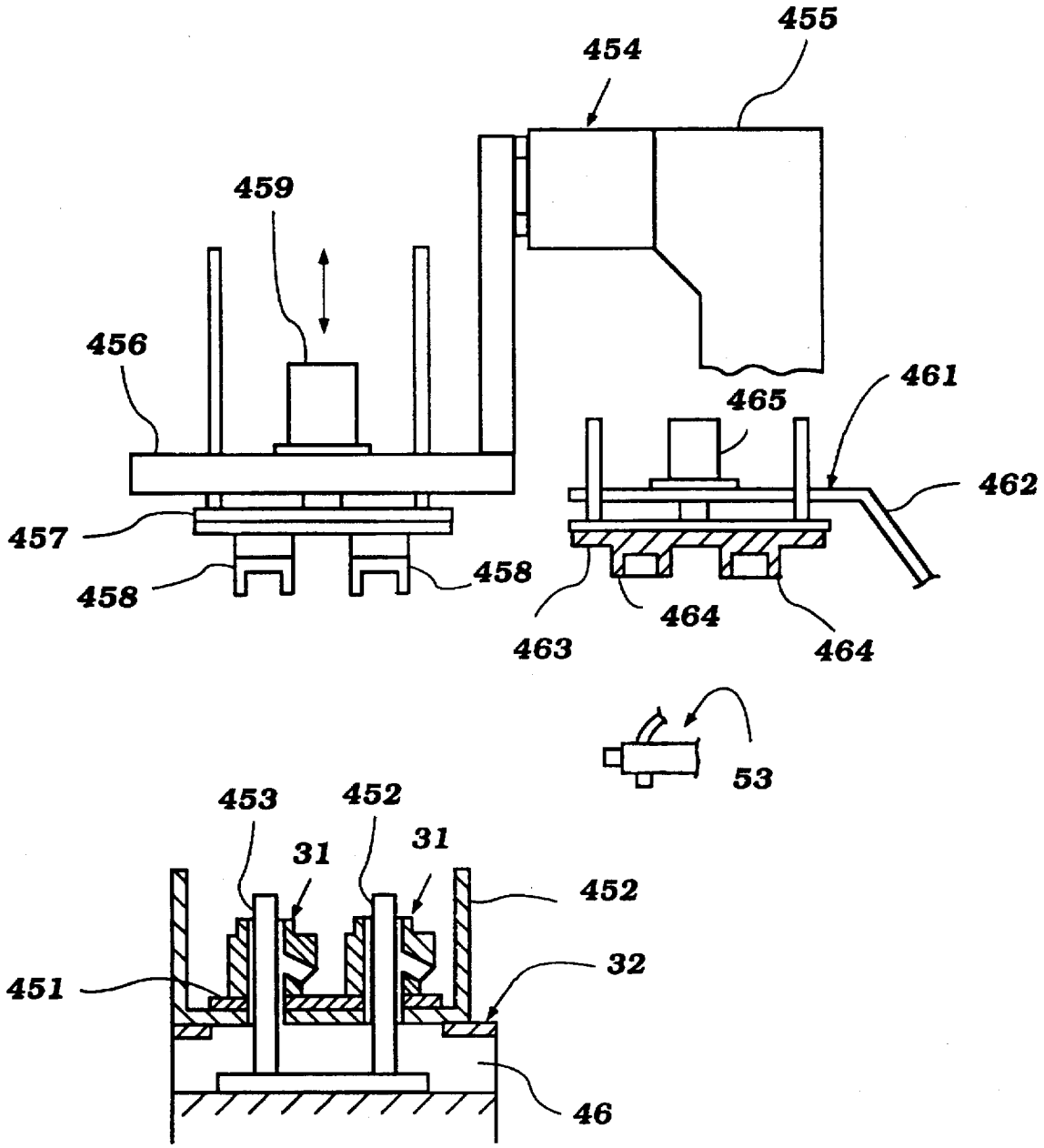
FIG. 20 is a side elevational view of a plating apparatus constructed in accordance with another embodiment of the invention and shows the conveyors for moving the work pieces to be plated, the end closure fixture and the make-up mechanism.

In reference certain of the figures already described, reference has been made to various jigs or holding fixtures for holding the cylinder blocks 31 in position, as well as conveyors, etc. for moving these cylinder blocks from station to station. FIG. 20 is a view that shows the overall apparatus and one in which a pair of two-cycle crankcase compression cylinder blocks 31 have their cylinder bores plated. The cylinder blocks 31, because the engine is of a two-cycle type, have exhaust and scavenge ports which extend through them and, thus, which complicate the sealing. Therefore, in this embodiment a support plate 451 is provided above the baseplate 32 and within a plating tank 452 which is supported on the base plate 32.

A pair of electrodes shown schematically at 453 and which may have a construction as any described embodiment extend upwardly through the cylinder bores of the cylinder blocks 31.

A conveyor apparatus, indicated generally by the reference numeral 54 is provided for moving the cylinder blocks 31 from one station to another of the plating operation. It should be understood that the plating operation includes a number of stations in addition to the actual plating station, such as degreasing stations, acid and alkaline etching stations, aluminide stations and various washing stations.

The conveyor apparatus 454 includes a base assembly 455 which mounts the conveyor apparatus 454 for movement along the line in a direction generally perpendicular to the plane of this figure. A conveyor 456 depends from the conveyor apparatus 454 and carries a pick-up head 457 that has a pair of clamps or cylinder block grippers for 458, each of which is adapted to engage and pick up a cylinder block 31 in a known manner.

A lift cylinder 459 is interposed between the base plate 456 and the pick-up head 457 for movement in the direction indicated by the arrows so as to lower the cylinder block grippers 458 to a position where they may grip the cylinder blocks 31 and raise and lower them. When appropriately raised, the conveyor 454 moves along the base 455 to the next adjacent station.

In addition, a jig fixture holder 461 is mounted adjacent the plating station on a robot or actuator arm 462 that can move over the tank 452 and which has the jig, indicated generally by the reference numeral 463 that includes a pair of sections 464, each of which cooperates with a respective one of the cylinder blocks 31 for holding it in position. This jig 463 is raised and lowered by a pneumatic or hydraulic servomotor 465 once in position over the cylinder blocks 31.

Again, the feeder 53 for supplying additional pellets as they become depleted also appears in this figure. This is moved into place when the cylinder block carrying conveyor 454 and the jig fixture 461 are out of position.

Figure 21:
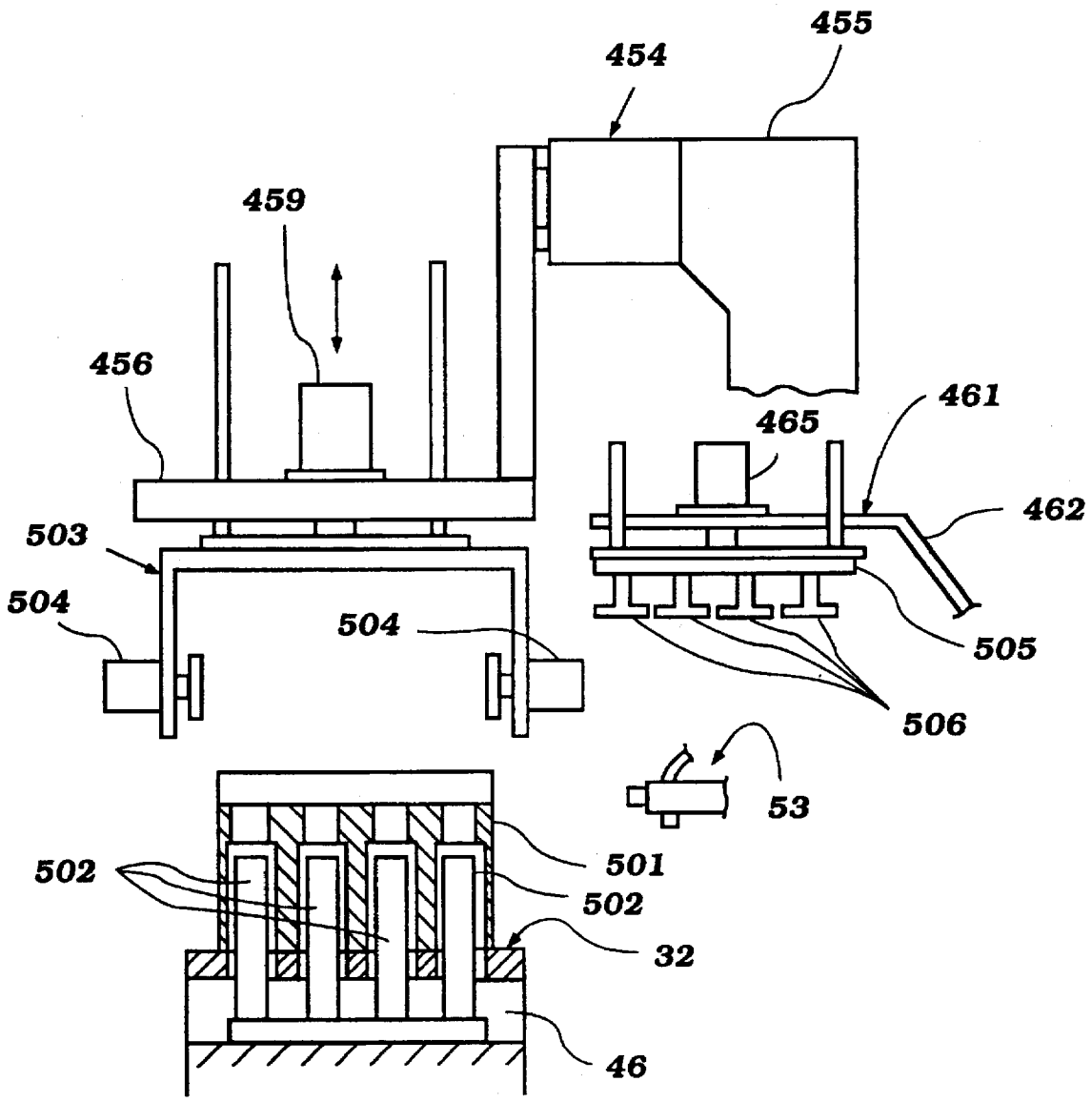
FIG. 21 is a view, in part similar to FIG. 20, and shows an apparatus that can be utilized for plating other types of work pieces and shows the same overall components as in FIG. 20 that are utilized for this application.

FIG. 21 shows an embodiment wherein four-cycle cylinder blocks, indicated by the reference numeral 501 may be plated. In this embodiment, a four-cylinder in-line engine is shown, but it will be readily apparent to those skilled in the art how the concept may be used with engines having other cylinder numbers and other cylinder configurations.

The cylinder block 501 is positioned head engaging surface down on the support plate 32 and the base assembly carries four electrodes 502 which may be of any of the types previously described.

A conveyor, indicated generally by the reference numeral 454 like that previously described, includes a special pick-up clamp assembly, indicated generally by the reference numeral 563 which has a pair of spaced apart clamping members 504 that are adapted to engage and pick up opposite sides of the cylinder block 501. This cylinder block pick-up mechanism 503 is carried by the remaining elements of the conveyor which are the same as previously described and which have, therefore, been identified by the same reference numerals.

This embodiment includes a jig, indicated by the reference numeral 505 that has four stopper plates 506 that are brought into sealing engagement with the cylinder block in any of the manners already described.

Thus, from the foregoing description, it should be readily apparent that the described embodiments of the invention are very effective in providing good and uniform plating over the entire cylinder bore length that is to be plated. In addition, the embodiments all provide a way in which replacement pellets may be automatically added with minimum down time and without the necessity of removing the electrodes for such replacement. Of course, the foregoing description is that of preferred embodiments of the invention, and various changes and modifications may be made without departing from the spirit and scope of the invention, as defined by the appended claims.

What is claimed is:

1. An electrical anode arrangement for plating cylindrical bores of work pieces, said anode being comprised of a tubular electrode comprised of an outer hollow tubular shell and an inner hollow tubular shell around which the cylinder bore to be plated is received, said electrode and said cylindrical bore forming a flow path comprised of a first axially extending tubular section formed between the outer surface of said outer hollow tubular shell and the inner surface of said cylinder bore and a second axially extending cylindrical section formed by the inner surface of said inner hollow tubular shell, means for forming a generally radially extending flow path section between said first and said second axial sections at one end of said cylinder bore, at least one of said shells being perforated, the tubular space between said shells being sized and shaped for filling with soluble pellets of the material to be plated upon said cylindrical bore, and means for adding make-up pellets to said tubular space from a point spaced axially beyond said cylinder bore.

2. An electrical anode arrangement as set forth in claim 1, where at least the outer shell of said tubular electrode extends axially beyond the cylindrical bore for forming a storage volume for make-up pellets axially beyond the cylinder bore.

3. An electrical anode arrangement as set forth in claim 2, wherein the outer shell is longer than the inner shell at the one end of the cylindrical bore.

4. An electrical anode arrangement as set forth in claim 3, further including means for forming a closure at the one end of the inner shell that permits fluid flow therethrough, but precludes pellets from entering therein.

5. An electrical anode arrangement as set forth in claim 2, wherein the means for providing make-up pellets comprises means for moving pellets into an area between the inner and outer shells.

6. An electrical anode arrangement as set forth in claim 5, wherein the means for moving the pellets effects movement of the pellets by means of gravity.

7. An electrical anode arrangement as set forth in claim 6, wherein the upper portion of the tubular space is open so that pellets can be added directly to the electrode without removal of the electrode from its mounting arrangement.

8. An electrical anode arrangement as set forth in claim 7, further including a pellet feeder for feeding pellets from an exterior source into the tubular space.

9. An electrical anode arrangement as set forth in claim 8, wherein the pellet feeder is movable between a retracted position away from the tubular space and an operative position in alignment with the tubular space.

10. An electrical anode arrangement as set forth in claim 9, wherein the pellet feeder includes a flow control for controlling the flow of pellets to the tubular space.

11. An electrical anode arrangement as set forth in claim 10, wherein the flow control is opened in response to the pellet level being below a predetermined pellet level.

12. An electrical anode arrangement as set forth in claim 11, wherein the flow control further is responsive to discontinue the flow of pellets to the tubular space when the pellet level reaches a predetermined level.

13. An electrical anode arrangement as set forth in claim 5, wherein the means for moving the pellets into the tubular area comprises a spring biasing member for biasing pellets from a storage area into the tubular area.

14. An electrical anode arrangement as set forth in claim 13, wherein one end of the tubular space is closed.

15. An electrical anode arrangement as set forth in claim 14, wherein an area of the electrode at the other end thereof forms the pellet storage area.

16. An electrical anode arrangement as set forth in claim 15, wherein the closure for the one end of the tubular area comprises an integral head.

17. An electrical anode arrangement as set forth in claim 15, further including means for closing the other end of the tubular area comprising a movable plate.

18. An electrical anode arrangement as set forth in claim 5, further including a plurality of slots formed in one of the tubular members for providing an effective increase in the effective width of the tubular space without permitting pellets to pass through the slots to avoid binding of the pellets along the tubular space.

19. An electrical anode arrangement as set forth in claim 18, wherein the slots extend in a generally axial direction.

20. An electrical anode arrangement as set forth in claim 19, wherein the slots are formed in the outer shell.

21. An electrical anode arrangement as set forth in claim 5, wherein there is provided means for applying an electrical force of a given polarity to the electrode for effecting the electrical plating of the cylinder bore and further including means for providing uniform electrical density through the plating fluid along the axial length of the cylinder bore.

22. An electrical anode arrangement as set forth in claim 21, wherein the means for providing uniform plating comprises means for effecting the electrical current density in the areas between the electrode and the cylinder bore.

23. An electrical anode arrangement as set forth in claim 22, wherein the means for varying the electrical current density comprises the formation of a non-soluble anode material on at least one of the shells.

24. An electrical anode arrangement as set forth in claim 23, wherein the non-soluble anode material is formed on the inner shell.

25. An electrical anode arrangement as set forth in claim 23, wherein the non-soluble anode material is formed on the outer shell.

26. An electrical anode arrangement as set forth in claim 23, wherein the non-soluble anode material is formed only at one end of the electrode.

27. An electrical anode arrangement as set forth in claim 26, wherein the non-soluble anode material is formed on the end of the electrode opposite where the electrical potential is applied to the anode.

28. An electrical anode arrangement as set forth in claim 27, wherein the non-soluble anode material is formed on the outer shell.

29. An electrical anode arrangement as set forth in claim 28, wherein the non-soluble anode material is also formed on the inner shell.

30. An electrical anode arrangement for plating cylindrical bores of work pieces, said anode being comprised of a tubular electrode comprised of an outer hollow tubular shell and an inner hollow tubular shell around which the cylinder bore to be plated is received, said electrode and said cylindrical bore forming a flow path comprised of a first axially extending tubular section formed between the outer surface of said outer hollow tubular shell and the inner surface of said cylinder bore and a second axially extending cylindrical section formed by the inner surface of said inner hollow tubular shell, means for forming a generally radially extending flow path section between said first and said second axial sections at one end of said cylinder bore, at least one of said shells being perforated, the tubular space between said shells being adapted to be filled with soluble pellets of the material to be plated upon said cylindrical bore, and a plurality of slots formed in one of said shells for providing an effective increase in the effective width of the tubular space without permitting pellets to pass through the slots to avoid binding of the pellets along the tubular space.

31. An electrical anode arrangement as set forth in claim 30, wherein the slots extend in a generally axial direction.

32. An electrical anode arrangement as set forth in claim 31, wherein the slots are formed in the outer shell.

33. An electrical anode arrangement as set forth in claim 30, wherein there is provided means for applying an electrical force of a given polarity to the electrode for effecting the electrical plating of the cylinder bore and further including means for providing uniform electrical density through the plating fluid along the axial length of the cylinder bore.

34. An electrical anode arrangement as set forth in claim 33, wherein the means for providing uniform plating comprises means for effecting the electrical density in the areas between the electrode and the cylinder bore.

35. An electrical anode arrangement as set forth in claim 34, wherein the means for varying the electrical density comprises the formation of a non-soluble anode material on at least one of the shells.

36. An electrical anode arrangement as set forth in claim 35, wherein the non-soluble anode material is formed on the inner shell.

37. An electrical anode arrangement as set forth in claim 35, wherein the non-soluble anode material is formed on the outer shell.

38. An electrical anode arrangement as set forth in claim 35, wherein the non-soluble anode material is formed only at one end of the electrode.

39. An electrical anode arrangement as set forth in claim 38, wherein the non-soluble anode material is formed on the end of the electrode opposite where the electrical potential is applied to the anode.

40. An electrical anode arrangement as set forth in claim 39, wherein the non-soluble anode material is formed on the outer shell.

41. An electrical anode arrangement as set forth in claim 40, wherein the non-soluble anode material is also formed on the inner shell.

42. An electrical anode arrangement for plating cylindrical bores of work pieces, said anode being comprised of a tubular electrode comprised of an outer shell and an inner shell around which the cylinder bore to be plated is received, said electrode and said cylindrical bore forming a flow path comprised of a first axially extending tubular section formed between the outer surface of said outer shell and the inner surface of said cylinder bore and a second axially extending cylindrical section formed by the inner surface of said inner shell, means for forming a generally radially extending flow path section between said first and said second axial sections at one end of said cylinder bore, at least one of said shells being perforated, the tubular space between said shell being adapted to be filled with soluble pellets of the material to be plated upon said cylindrical bore, means for applying an electrical force of a given polarity to said electrode for effecting the electrical plating of said cylinder bore, and means for providing uniform electrical density through the plating fluid along the axial length of the cylinder bore.

43. An electrical anode arrangement as set forth in claim 42, wherein the means for providing the uniform electrical density comprises the formation of a non-soluble anode material on at least one of the shells.

44. An electrical anode arrangement as set forth in claim 42, wherein the non-soluble anode material is formed on the inner shell.

45. An electrical anode arrangement as set forth in claim 42, wherein the non-soluble anode material is formed on the outer shell.

46. An electrical anode arrangement as set forth in claim 42, wherein the non-soluble anode material is formed only at one end of the electrode.

47. An electrical anode arrangement as set forth in claim 46, wherein the non-soluble anode material is formed on the end of the electrode opposite where the electrical potential is applied to the anode.

48. An electrical anode arrangement as set forth in claim 47, wherein the non-soluble anode material is formed on the outer shell.

49. An electrical anode arrangement as set forth in claim 48, wherein the non-soluble anode material is also formed on the inner shell.

* * * * *